US010472805B1

(12) United States Patent
Kumeuchi et al.

(10) Patent No.: US 10,472,805 B1
(45) Date of Patent: Nov. 12, 2019

(54) HYDRAULIC DRIVE UNIT OF HYDRAULIC EXCAVATOR

(71) Applicant: Takeuchi Mfg. Co., Ltd., Nagano (JP)

(72) Inventors: Kengo Kumeuchi, Chikuma (JP); Koichi Shimizu, Ueda (JP); Yuta Kobayashi, Tomi (JP); Shumpei Okutani, Ueda (JP); Takahiro Watanabe, Tomi (JP)

(73) Assignee: Takeuchi Mfg. Co., Ltd., Nagano (JP)

( * ) Notice: Subject to any disclaimer, the term of this patent is extended or adjusted under 35 U.S.C. 154(b) by 0 days.

(21) Appl. No.: 16/168,033

(22) Filed: Oct. 23, 2018

(30) Foreign Application Priority Data

May 11, 2018 (JP) ..... 2018-092537

(51) Int. Cl.
*E02F 9/22* (2006.01)
*F15B 11/17* (2006.01)
(Continued)

(52) U.S. Cl.
CPC ..... *E02F 9/2292* (2013.01); *E02F 3/30* (2013.01); *E02F 3/425* (2013.01); *E02F 9/123* (2013.01); *E02F 9/2221* (2013.01); *F15B 11/165* (2013.01); *F15B 11/17* (2013.01); *E02F 3/961* (2013.01); *E02F 3/964* (2013.01); *F15B 2211/20515* (2013.01); *F15B 2211/20576* (2013.01); *F15B 2211/255* (2013.01); *F15B 2211/275* (2013.01); *F15B 2211/428* (2013.01); *F15B 2211/6313* (2013.01);
(Continued)

(58) Field of Classification Search
CPC ..... F15B 11/17; F15B 2211/20576; F15B 2211/20515; E02F 9/2292
See application file for complete search history.

(56) References Cited

U.S. PATENT DOCUMENTS

2005/0001567 A1* 1/2005 Yoshimatsu ..... E02F 9/2075 318/34
2011/0056194 A1* 3/2011 Wojcicki ..... E02F 9/2242 60/428

FOREIGN PATENT DOCUMENTS

EP 1291467 A1 3/2003
JP 2000-273913 A 10/2000
(Continued)

OTHER PUBLICATIONS

Office Action issued in JP 2018-092537; mailed by the Japanese Patent Office dated Dec. 25, 2018.
(Continued)

*Primary Examiner* — Michael Leslie
*Assistant Examiner* — Daniel S Collins
(74) *Attorney, Agent, or Firm* — Studebaker & Brackett PC

(57) ABSTRACT

A hydraulic drive unit of a hydraulic excavator is configured to include a first hydraulic pump (P1) that discharges a hydraulic oil for activating a boom cylinder (36) and the like, a first electric motor (M1) that drives the first hydraulic pump (P1), a hydraulic pump for revolution (P2) that discharges a hydraulic oil for activating a revolution motor (26), a second electric motor (M2) that drives the hydraulic pump for revolution (P2), and a motor control device (150) that controls the rotation of the first electric motor (M1) and that of the second electric motor (M2). The motor control device (150) is configured such that when the revolution of the revolving body is not activated by the revolution motor (26), control to deactivate the second electric motor (M2) is performed.

5 Claims, 2 Drawing Sheets

(51) Int. Cl.

| | |
|---|---|
| ***E02F 3/30*** | (2006.01) |
| ***E02F 3/42*** | (2006.01) |
| ***F15B 11/16*** | (2006.01) |
| ***E02F 9/12*** | (2006.01) |
| *E02F 3/96* | (2006.01) |

(52) U.S. Cl.
CPC ..... *F15B 2211/6651* (2013.01); *F15B 2211/6654* (2013.01); *F15B 2211/7053* (2013.01); *F15B 2211/7058* (2013.01); *F15B 2211/7135* (2013.01)

(56) References Cited

FOREIGN PATENT DOCUMENTS

| | | | |
|---|---|---|---|
| JP | 5096417 | B2 | 12/2012 |
| JP | 2017-115992 | A | 6/2017 |
| JP | 2017-206867 | A | 11/2017 |
| WO | 2010/028100 | A1 | 3/2010 |
| WO | 2012/039083 | A1 | 3/2012 |
| WO | 2016/039490 | A1 | 3/2016 |

OTHER PUBLICATIONS

Office Action issued in JP 2018-092537; mailed by the Japanese Patent Office dated Dec. 4, 2018.
Extended European Search Report issued by the European Patent Office dated Mar. 26, 2019, which corresponds to EP18203263.1-1018 and is related to U.S. Appl. No. 16/168,033.

* cited by examiner

HYDRAULIC DRIVE UNIT OF HYDRAULIC EXCAVATOR

TECHNICAL FIELD

The present invention relates to a hydraulic excavator including a plurality of hydraulic actuators, and relates to a hydraulic drive unit of the hydraulic excavator, in which a hydraulic pump is driven by an electric motor.

BACKGROUND OF THE INVENTION

A hydraulic excavator (or hydraulic shovel) includes a traveling body having left and right crawler mechanisms, a revolving body revolvably provided on the traveling body, and an excavator device provided at the front of the revolving body. As such a hydraulic excavator, a hydraulic excavator including a power supply unit having a battery and an inverter, an electric motor that drives in response to electricity from the power supply unit, a hydraulic pump driven by the electric motor, and a plurality of hydraulic motors and hydraulic cylinders that are activated in response to a hydraulic oil discharged from the hydraulic pump is known. The hydraulic excavator is configured such that the crawler mechanisms, the excavator device, and the like are activated by the hydraulic motors and hydraulic cylinders, thereby performing travel, excavation work, and the like.

Hydraulic actuators provided in such a hydraulic excavator include a traveling motor for activating the crawler mechanisms, a revolution motor for revolving the revolving body, a boom cylinder, an arm cylinder, a bucket cylinder, and a swing cylinder for activating an excavator device, a blade cylinder for moving a blade up and down, and the like. As a conventional hydraulic excavator, one equipped with a hydraulic drive unit configured such that a plurality of hydraulic pumps (including a pilot pump) are driven by one electric motor, and, using hydraulic oils discharged from these hydraulic pumps, a plurality of hydraulic actuators as described above are activated, and also a pilot pressure is generated, is known. In such a hydraulic drive unit, it is necessary to drive all the hydraulic pumps by one electric motor in order to achieve a pump discharge pressure corresponding to the maximum load pressure among all the hydraulic actuators. Therefore, it has often happened that the electric motor consumes extra energy.

Then, a hydraulic drive unit including two electric motors, and configured such that a traveling motor and hydraulic cylinders of an excavator device (boom cylinder, etc.) are activated using a hydraulic oil from a hydraulic pump driven by the first electric motor, and, using a hydraulic oil from a hydraulic pump driven by the second electric motor, a revolution motor and a blade cylinder are activated, and also a pilot pressure is generated, is also known (e.g., Japanese Patent No. 5096417B2). In such a hydraulic drive unit, it is possible that at the time of traveling and the activation of the excavator device only, the rotation speed (the number of rotations per unit time) of the second electric motor (electric motor for revolution, etc.) is suppressed low, while at the time of revolution and the activation of the blade only, the rotation speed of the first electric motor (electric motor for traveling, etc.) is suppressed low. As a result, the energy consumption of the two electric motors can be suppressed.

Problems Solved by the Invention

A hydraulic drive unit including two electric motors as described above is configured such that a hydraulic oil from a hydraulic pump driven by the second electric motor is used not only to activate the revolution motor and the blade cylinder but also to generate a pilot pressure. Therefore, at the time of traveling and the activation of the excavator device only, the rotation speed of the second electric motor can be suppressed low. However, for the generation of a pilot pressure, it has not been possible to completely deactivate the second electric motor. Thus, there has been a demand for a hydraulic drive unit capable of further reducing the energy (electricity) consumed by an electric motor and achieving further energy saving.

SUMMARY OF THE INVENTION

The present invention has been accomplished in view of these problems, and an object thereof is to provide a hydraulic drive unit of a hydraulic excavator, which is capable of reducing the energy consumed by an electric motor and achieving further energy saving.

In order to achieve the above object, the present invention provides a hydraulic drive unit of a hydraulic excavator, which is for use in a hydraulic excavator including a traveling body capable of traveling; a revolving body provided on the traveling body in a horizontally revolvable manner and horizontally revolved by a revolution hydraulic actuator; and an excavator device provided to the revolving body and driven by a plurality of activation hydraulic actuators (e.g., a boom cylinder 36, an arm cylinder 37, and a bucket cylinder 38 in the embodiment). The hydraulic drive unit includes a first hydraulic pump that discharges a hydraulic oil for activating the plurality of activation hydraulic actuators; a first electric motor that drives the first hydraulic pump; a hydraulic pump for revolution that discharges a hydraulic oil for activating the revolution hydraulic actuator; a second electric motor that drives the hydraulic pump for revolution; and a motor controller that controls the rotation of the first electric motor and that of the second electric motor (e.g., a motor control device 150 in the embodiment). Then, the hydraulic drive unit is configured such that when the revolution of the revolving body is not activated by the revolution hydraulic actuator, the motor controller performs control to deactivate the second electric motor.

In the hydraulic drive unit thus configured, the configuration is preferably such that the motor controller controls the rotation of the second electric motor, thereby controlling the revolution speed at the time of activating the revolution of the revolving body by the revolution hydraulic actuator.

In the hydraulic drive unit thus configured, the configuration is preferably such that the hydraulic drive unit includes a pressure sensor (e.g., a second pressure sensor S2 in the embodiment) that detects the maximum load pressure among the load pressures of the plurality of activation hydraulic actuators, and the motor controller controls the rotation of the first electric motor, thereby controlling the discharge flow rate of the first hydraulic pump in such a manner that the discharge pressure of the first hydraulic pump is slightly higher than the maximum load pressure.

In the hydraulic drive unit thus configured, the configuration is preferably such that when at least one of the plurality of activation hydraulic actuators and the revolution hydraulic motor are activated together, the motor controller controls the rotation of the first electric motor, thereby controlling the discharge flow rate of the first hydraulic pump in such a manner that the discharge flow rate of the first hydraulic pump is reduced by the discharge flow rate of the hydraulic pump for revolution.

In the hydraulic drive unit thus configured, the configuration is preferably such that the hydraulic drive unit includes an actuator operation unit operated to activate each of the plurality of activation hydraulic actuators and the revolution hydraulic actuator; a plurality of first control valves (e.g., a control valve unit 110 in the embodiment) that control the flow rates of respective hydraulic oils supplied from the first hydraulic pump to the plurality of activation hydraulic actuators; a revolution control valve that controls the flow rate of a hydraulic oil supplied from the hydraulic pump for revolution to the revolution hydraulic actuator; and a pilot pressure supply unit (e.g., a pilot valve unit 130 in the embodiment) that supplies a pilot pressure for driving each of the plurality of first control valves and the revolution control valve according to the operation of the actuator operation unit, and the pilot pressure supply unit generates the pilot pressure using a hydraulic oil discharged from the first hydraulic pump.

In the hydraulic drive unit thus configured, the configuration is preferably such that the first hydraulic pump discharges a hydraulic oil for activating a traveling hydraulic motor provided to the traveling body.

Advantageous Effects of the Invention

The hydraulic drive unit according to the present invention includes a first hydraulic pump that discharges a hydraulic oil for activating a plurality of activation hydraulic actuators of an excavator device, a first electric motor that drives the first hydraulic pump, a hydraulic pump for revolution that discharges a hydraulic oil for activating a revolution hydraulic actuator, a second electric motor that drives the hydraulic pump for revolution, and a motor controller that controls the rotation of the first electric motor and that of the second electric motor, and is configured such that when the revolution of the revolving body is not activated by the revolution hydraulic actuator, the motor controller performs control to deactivate the second electric motor. Therefore, when only the excavator device is activated without activating revolution, the second electric motor can be completely deactivated. Accordingly, as compared with conventional hydraulic drive units, the energy (electricity) consumed by the second electric motor can be reduced, and further energy saving can be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DETAILED DESCRIPTION OF THE PREFERRED EMBODIMENTS

Hereinafter, an embodiment of the present invention will be described with reference to the drawings. In this embodiment, as an example of a hydraulic excavator equipped with the hydraulic drive unit according to the present invention, a crawler-type hydraulic excavator (or hydraulic shovel) will be described. First, the entire configuration of a hydraulic excavator 1 will be described with reference to FIG. 1.

Figure 1:
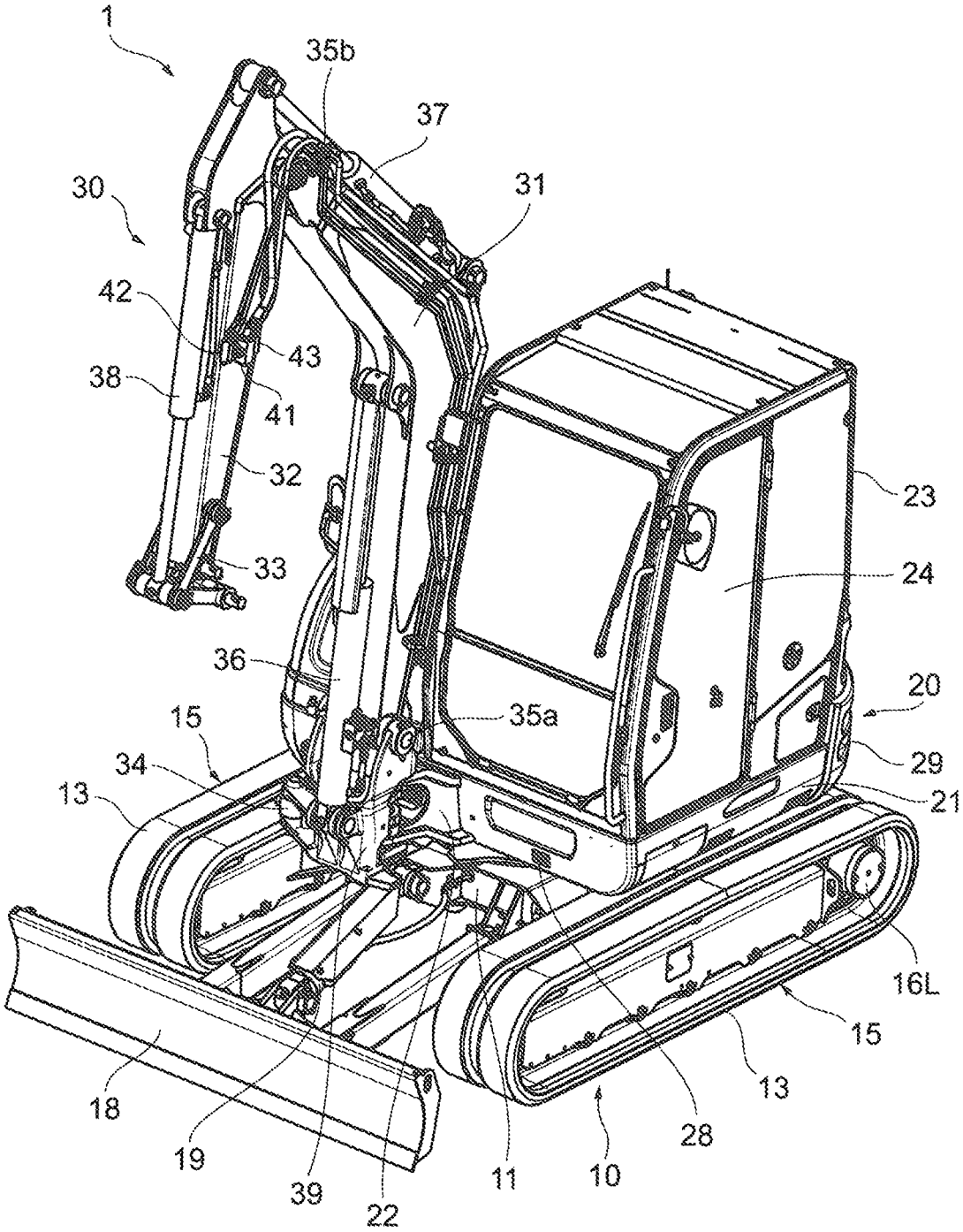
FIG. 1 is a perspective view of a hydraulic excavator equipped with a hydraulic drive unit according to the present invention.

As shown in FIG. 1, the hydraulic excavator 1 is configured to have a traveling body 10 configured to be capable of traveling, a revolving body 20 provided on the traveling body 10 in a horizontally revolvable manner, and an excavator device 30 provided at the front of the revolving body 20.

The traveling body 10 is configured to include a pair of left and right crawler mechanisms 15 on the left and right sides of a traveling body frame 11, respectively. The crawler mechanisms 15 each have a driving wheel, a plurality of idler wheels, and a crawler belt 13 placed around these wheels. The left and right crawler mechanisms 15 are configured to have left and right traveling motors 16L and 16R that drive the rotation of the driving wheels. By controlling the rotation direction and the rotation speed of the left and right traveling motors 16L and 16R, the traveling body 10 is allowed to travel in an arbitrary direction at an arbitrary speed. In front of the traveling body frame 11, a blade 18 is provided in a vertically swingable manner. The blade 18 is configured to be vertically swingable upon the activation of the expansion/contraction of a blade cylinder 19 provided between the blade 18 and the traveling body frame 11.

In the upper center of the traveling body frame 11, a revolution mechanism is provided. The revolution mechanism is configured to have an inner ring fixed to the traveling body frame 11, an outer ring fixed to the revolving body 20, a revolution motor 26 (see FIG. 2) provided to the revolving body 20, left and right traveling motors 16L and 16R provided to the traveling body 10 from a hydraulic pump provided to the revolving body 20, and a rotary center joint for supplying a hydraulic oil to the blade cylinder 19. The revolving body 20 is attached to the traveling body frame 11 in a horizontally revolvable manner through the revolution mechanism, and configured to be revolvable in the left-right direction relative to the traveling body 10 upon the activation of the normal rotation or reverse rotation of the revolution motor 26. At the front of the revolving body 20, a main body-side bracket 22 projecting forward is provided.

The excavator device 30 is configured to have a boom bracket 39 attached to the main body-side bracket 22 so as to be swingable in the left-right direction centering around the vertical axis, a boom 31 attached to the boom bracket 39 by the first swing pin 35*a* in a vertically swingable manner (capable of undulating motions), an arm 32 attached to a front end portion of the boom 31 by a second swing pin 35*b* in a vertically swingable manner (capable of bending and stretching motions), and a link mechanism 33 provided at a front end portion of the arm 32. The excavator device 30 is configured to further have a swing cylinder 34 provided between the revolving body 20 and the boom bracket 39, a boom cylinder 36 provided between the boom bracket 39 and the boom 31, an arm cylinder 37 provided between the boom 31 and the arm 32, and a bucket cylinder 38 provided between the arm 32 and the link mechanism 33.

The boom bracket 39 is configured to be swingable in the left-right direction relative to the revolving body 20 (main body-side bracket 22) upon the activation of the expansion/contraction of the swing cylinder 34. The boom 31 is configured to be swingable in the up-down direction (capable of undulating motions) relative to the main body-side bracket 22 (revolving body 20) upon the activation of the expansion/contraction of the boom cylinder 36. The arm 32 is configured to be swingable in the up-down direction (capable of bending and stretching motions) relative to the boom 31 upon the activation of the expansion/contraction of the arm cylinder 37.

At front end portions of the arm 32 and the link mechanism 33, various attachments, such as a bucket, a breaker, a crusher, a cutter, and an auger device, can be attached so as to be swingable in the up-down direction. Each attachment attached to the front end portion of the arm 32 is configured to be vertically swingable relative to the arm 32 through the link mechanism 33 upon the activation of the expansion/contraction of the bucket cylinder 38. On both left and right side surfaces of the arm 32, first to third attachment connection ports 41 to 43, to which a hydraulic hose for supplying a hydraulic oil to the hydraulic actuator of such an attachment can be connected, are provided.

The revolving body 20 is configured to have a revolving frame 21, at the front of which the main body-side bracket 22 is provided, and an operator cabin 23 provided on the revolving frame 21. The operator cabin 23 is formed to have an approximately rectangular box shape. An operation room where the operator (worker) can get in is formed inside, and a cabin door 24 that can be opened and closed sideways is provided on the left side. Inside the operator cabin 23, provided are an operator seat where the operator is seated facing forward, left and right traveling operation levers and traveling operation pedals for performing the traveling operation of the traveling body 10, left and right work operation levers for performing the activation operation of the revolving body 20 and the excavator device 30, a blade operation lever for performing the activation operation of the blade 18, a display device that displays various types of vehicle information in the hydraulic excavator 1, and various operation switches operated by the operator.

The hydraulic excavator 1 is configured such that when the operator gets into the operator cabin 23 and operates the left and right traveling operation levers (or traveling operation pedals) to tilt back and forth, the left and right crawler mechanisms 15 (traveling motors 16L and 16R) are driven according to the operation direction and the operation amount, whereby the hydraulic excavator 1 is allowed to travel. In addition, the left and right work operation levers are operated to tilt back and forth and left and right, the revolving body 20 and the excavator device 30 are driven according to the operation direction and the operation amount, whereby digging or like work can be performed.

At the front of the revolving frame 21, a horn device 28 is provided. A horn switch in the operator cabin 23 can be pressed to make an alarm from the horn device 28 to call attention around the hydraulic excavator 1. At the rear of the revolving frame body 20, in a position behind the operator cabin 23, a mounting chamber on which the below-described hydraulic drive unit 100 is mounted is provided. A counter weight 29 having a curved shape is provided to form the back wall of the mounting chamber.

Figure 2:
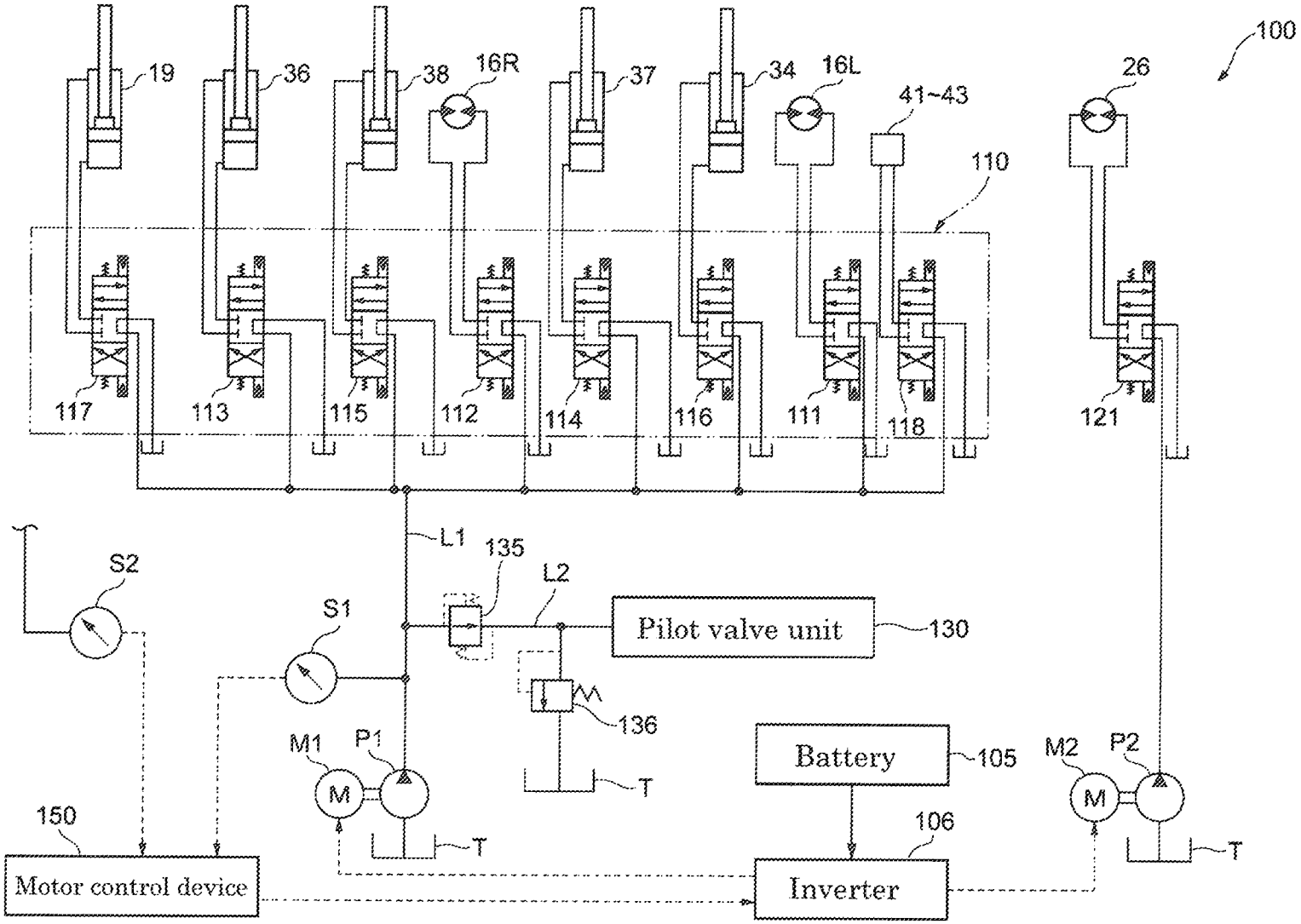
FIG. 2 is a hydraulic circuit diagram showing the hydraulic drive unit according to the present invention.

The hydraulic drive unit 100 includes, as shown in FIG. 2, a hydraulic oil tank T, a first hydraulic pump P1 that discharges a hydraulic oil for activating the left and right traveling motors 16L and 16R and the like, a hydraulic pump for revolution P2 that discharges a hydraulic oil only for activating the revolution motor 26, a control valve unit 110 that controls the supply direction and the flow rate of a hydraulic oil discharged from the first hydraulic pump P1 and supplied to the left and right traveling motors 16L and 16R and the like, a revolution control valve 121 that controls the supply direction of a hydraulic oil discharged from the hydraulic pump for revolution P2 and supplied to the revolution motor 26, and a pilot valve unit 130 that generates a pilot pressure for driving each of the control valve unit 110 and the revolution control valve 121.

The control valve unit 110 has left and right traveling control valves 111 and 112 that control the supply direction and the flow rate of a hydraulic oil supplied to each of the left and right traveling motors 16L and 16R, the boom cylinder 36, the arm cylinder 37, the bucket cylinder 38, the swing cylinder 34, the blade cylinder 19, and the first to third attachment connection ports 41 to 43, a boom control valve 113, an arm control valve 114, a bucket control valve 115, a swing control valve 116, a blade control valve 117, and an attachment control valve 118. These control valves 111 to 118 are each configured such that a built-in spool is moved by the pilot pressure supplied from the pilot valve unit 130, and the supply direction and the flow rate of a hydraulic oil supplied to each hydraulic actuator can be controlled by the movement of the spool.

The revolution control valve 121 is configured such that a built-in spool is moved by the pilot pressure supplied from the pilot valve unit 130 like the control valves 111 to 118, but only the supply direction of a hydraulic oil supplied to the revolution motor 26 is controlled by the movement of the spool. Control of the flow rate of the hydraulic oil supplied to the revolution motor 26 (i.e., control of the revolution speed of the revolving body 20) is performed by control of the rotation of the second electric motor M2 described below.

The pilot valve unit 130 is provided in a branched oil passage L2, which is branched from a pump oil passage L1 traveling from the discharge port of the first hydraulic pump P1 to the control valve unit 110. The branched oil passage L2 includes a check valve 135 and a relief valve 136 for maintaining the oil pressure required in order for the pilot valve unit 130 to generate a pilot pressure. The pilot valve unit 130 is configured such that using a hydraulic oil discharged from the first hydraulic pump P1, a pilot pressure according to the operation direction and the operation amount of each of the traveling operation levers (traveling operation pedals), the work operation levers, and the blade operation lever provided in the operator cabin 23 is generated and supplied to the corresponding control valve.

The hydraulic drive unit 100 further includes a first electric motor M1 that drives the first hydraulic pump P1, a second electric motor M2 that drives the hydraulic pump for revolution P2, a battery 105 that can be charged by an external power supply or the like (secondary battery), an inverter 106 that converts a direct-current power from the battery 105 into an alternating-current power to change the frequency and the magnitude of voltage, a first pressure sensor S1 that detects the hydraulic oil pressure (pump pressure) discharged from the first hydraulic pump P1, a second pressure sensor S2 that detects the load pressure that is highest among the load pressures of left and right traveling motors 16L and 16R and the like (maximum load pressure), and a motor control device 150 (controller) that controls the rotation speeds (the number of rotations per unit time) of the first and second electric motors M1 and M2 through the inverter 106.

The first hydraulic pump P1 and the hydraulic pump for revolution P2 are each a fixed-volume hydraulic pump and discharge a hydraulic oil at a flow rate according to the output of the first or second electric motor M1/M2. Although not shown in detail in FIG. 2, the second pressure sensor S2 is connected to oil passages traveling from the control valve unit 110 to the left and right traveling motors 16L and 16R and the like, respectively, through a plurality of shuttle valves and the like. As a result, the second pressure sensor S2 is capable of detecting the load pressure that is highest among the load pressures of the hydraulic actuators connected to the left and right traveling motors 16L and 16R, the boom cylinder 36, the arm cylinder 37, the bucket cylinder 38, the swing cylinder 34, the blade cylinder 19, and the first to third attachment connection ports 41 to 43 (maximum load pressure).

The motor control device 150 is configured to compare the discharge pressure of the first hydraulic pump P1 detected by the first pressure sensor S1 with the maximum load pressure among the load pressures of the left and right traveling motor 16L and 16R and the like detected by the second pressure sensor S2, and control the rotation speed of the first electric motor M1 through the inverter 106, thereby controlling the discharge flow rate of the first hydraulic pump P1 in such a manner that the discharge pressure of the first hydraulic pump P1 is slightly higher than the maximum load pressure. That is, the configuration is such that when at least one of the hydraulic actuators connected to the left and right traveling motors 16L and 16R, the boom cylinder 36, the arm cylinder 37, the bucket cylinder 38, the swing cylinder 34, the blade cylinder 19, and the first to third attachment connection ports 41 to 43 is activated according to the operation of the traveling operation levers, the work operation levers, and the blade operation lever in the operator cabin 23, the rotation speed of the first electric motor M1 is adjusted according to the maximum load pressure which varies as a result of such activation, thereby adjusting the discharge flow rate of the first hydraulic pump P1 to control the discharge pressure of the first hydraulic pump P1 to be slightly higher than the maximum load pressure. With respect to this slightly higher discharge pressure, for example, in the case where the maximum load pressure of the hydraulic actuators varies within a range of 0 to 20.6 MPa (system pressure), the discharge pressure is preferably controlled to be about 1.5 MPa higher than the maximum load pressure.

The motor control device 150 is further configured to control the rotation speed of the second electric motor M2 through the inverter 106 so as to control the discharge flow rate of the hydraulic pump for revolution P2, that is, the flow rate of a hydraulic oil supplied to the revolution motor 26, thereby controlling the revolution speed when revolving the revolving body 20. That is, the configuration is such that when the revolving body 20 is revolved by the revolution motor 26 according to the operation of the work operation levers in the operator cabin 23, the rotation speed of the second electric motor M2 is adjusted according to the operation amount of the work operation levers, thereby adjusting the flow rate of the hydraulic oil discharged from the hydraulic pump for revolution P2 and supplied to the revolution motor 26 so as to control the revolution speed of the revolving body 20 to be the revolution speed according to the operation amount of the work operation levers. In addition, when the revolution of the revolving body 20 is not activated by the revolution motor 26, the motor control device 150 performs control to completely deactivate the second electric motor M2.

Further, the configuration is such that when at least one of the hydraulic actuators connected to the left and right traveling motors 16L and 16R, the boom cylinder 36, the arm cylinder 37, the bucket cylinder 38, the swing cylinder 34, the blade cylinder 19, and the first to third attachment connection ports 41 to 43 is activated together with the revolution motor 26, the motor control device 150 controls the rotation speed of the first electric motor M1 through the inverter 106, thereby controlling the discharge flow rate of the first hydraulic pump P1 in such a manner that the discharge flow rate of the first hydraulic pump P1 is reduced by the discharge flow rate of the hydraulic pump for revolution P2. That is, the configuration is such that when the revolution of the revolving body 20 is activated at the same time as the activation of the crawler mechanisms 15 or the excavator device 30, the rotation speed of the first electric motor M1 is adjusted according to the discharge flow rate of the hydraulic pump for revolution P2 (rotation speed of the second electric motor M2), thereby performing control to reduce the discharge flow rate of the first hydraulic pump P1 by the discharge flow rate of the hydraulic pump for revolution P2 (the horsepower of the first hydraulic pump P1 is suppressed in an amount of the horsepower of the hydraulic pump for revolution P2). Incidentally, in the case of an engine, because the engine output=torque×rotation speed, it is difficult to form a higher output than the predetermined output (rated output). Meanwhile, in the case of an electric motor, because the electric motor output=current×voltage, it is possible to form a higher output than the predetermined output. Therefore, in the case of an electric motor, the above control is possible.

In the hydraulic drive unit thus configured, when the operation to activate at least one of the crawler mechanisms 15, the excavator device 30, the blade 19, and the attachments connected to the first to third attachment connection ports 41 to 43 is performed by at least one of the traveling operation levers, the work operation levers, and the blade operation lever in the operator cabin 23, the pilot valve unit 130 generates a pilot pressure according to the operation direction and the operation amount of the operation lever using the hydraulic oil discharged from the first hydraulic pump P1. The pilot pressure drives the control valve of the corresponding hydraulic actuator, and the hydraulic oil discharged from the first hydraulic pump P1 is controlled in supply direction and flow rate by the control valve and supplied to the hydraulic actuator. In this manner, in the activation direction at the activation speed according to the operation direction and the operation amount of the operation lever, the crawler mechanisms 15, the excavator device 30, the blade 19, and the attachments connected to the first to third attachment connection ports 41 to 43 are activated.

At this time, at least one of the hydraulic actuators connected to the left and right traveling motors 16L and 16R, the boom cylinder 36, the arm cylinder 37, the bucket cylinder 38, the swing cylinder 34, the blade cylinder 19, and the first to third attachment connection ports 41 to 43 is activated, and thus the maximum load pressure detected by the second pressure sensor S2 varies. Therefore, in such a manner that the discharge pressure of the first hydraulic pump P1 detected by the first pressure sensor S1 is higher by a predetermined pressure than the maximum load pressure detected by the second pressure sensor S2, the motor control device 150 controls the rotation speed of the first electric motor M1 to adjust the discharge pressure of the first hydraulic pump P1. In addition, at this time, in the case where the operation to activate the revolution of the revolving body 20 is also performed by the work operation levers in the operator cabin 23, the discharge flow rate of the first hydraulic pump P1 is reduced by the discharge flow rate discharged from the hydraulic pump for revolution P2 (the horsepower of the first hydraulic pump P1 is suppressed in an amount of the horsepower of the hydraulic pump for revolution P2).

When the operation to activate the revolution of the revolving body 20 is not performed by the work operation levers in the operator cabin 23, the motor control device 150 does not supply electricity to the second electric motor M2 and completely deactivates the second electric motor M2 and the hydraulic pump for revolution P2. Then, when the operation to activate the revolution of the revolving body 20 is performed, the pilot valve unit 130 generates a pilot pressure according to the operation direction of the work operation levers using the hydraulic oil discharged from the first hydraulic pump P1. The pilot pressure drives the revolution control valve 121, and the hydraulic oil discharged from the hydraulic pump for revolution P2 is controlled in supply direction by the revolution control valve 121 and supplied to the revolution motor 26. The motor control device 150 controls the rotation speed of the second electric motor M2 according to the operation amount of the work operation levers and controls the discharge flow rate of the hydraulic pump for revolution P2 to control the flow rate of the hydraulic oil supplied to the revolution motor 26. In this manner, the revolution of the revolving body 20 is activated in the revolution direction at the revolution speed according to the operation direction and the operation amount of the work operation levers.

Like this, in the hydraulic drive unit 100, when the revolution of the revolving body 20 is not activated by the revolution hydraulic motor 26, control to deactivate the second electric motor M2 and the hydraulic pump for revolution P2 is performed. Therefore, in the case of only traveling by the crawler mechanisms 15 and the activation of the excavator device 30, the second electric motor M2 can be completely deactivated. Accordingly, as compared with conventional hydraulic drive units, the electricity consumed by the second electric motor M2 can be reduced, and further energy saving can be achieved. In addition, in the hydraulic drive unit 100, in the case where the revolution of the revolving body 20 is activated together with the crawler mechanisms 15, the excavator device 30, and the like, control to reduce the discharge flow rate of the first hydraulic pump P1 by the discharge flow rate discharged from the hydraulic pump for revolution P2 (the horsepower of the first hydraulic pump P1 is suppressed in an amount of the horsepower of the hydraulic pump for revolution P2) is performed. Accordingly, the total electricity consumption of the first and second electric motors M1 and M2 can be suppressed below a certain value. Further, in a conventional hydraulic drive unit in which all the hydraulic pumps are driven by an engine, control to suppress the horsepowers of hydraulic pumps other than one for revolution has been similarly performed. Therefore, the operation feeling can be close to the operation feeling of conventional hydraulic drive units.

An embodiment of the present invention has been described above, but the scope of the prevent invention is not limited to the above embodiment. For example, in the above embodiment, the pilot valve unit 130 is configured to generate a pilot pressure using a hydraulic oil from the first hydraulic pump P1. However, the configuration may also be such that a pilot hydraulic pump driven together with the first hydraulic pump P1 by the first electric motor M1 is provided, and a pilot pressure is generated using a hydraulic oil from the pilot hydraulic pump. In addition, in the above embodiment, the left and right traveling motors 16L and 16R are formed of hydraulic motors activated in response to a hydraulic oil from the first hydraulic pump P1. However, the configuration may also be such that in place of these traveling motors 16L and 16R, traveling is caused by an electric motor activated by electricity supplied from the battery 105 or the like. In addition, in the above embodiment, it has been described that the battery 105 is charged by an external power supply or the like. However, the configuration may also be such that an engine and a power generator driven by the engine are mounted, and the battery 105 is charged by the power generator.

In the above embodiment, the configuration is such that when the revolution of the revolving body 20 is activated at the same time as the activation of the crawler mechanism 15 or the excavator device 30, control to reduce the discharge flow rate of the first hydraulic pump P1 by the discharge flow rate of the hydraulic pump for revolution P2 (the horsepower of the first hydraulic pump P1 is suppressed in an amount of the horsepower of the hydraulic pump for revolution P2) is performed. However, the configuration may also be such that the control to suppress the discharge flow rate (horsepower) of the first hydraulic pump P1 is not performed. In addition, in the above embodiment, the configuration is such that when the revolution of the revolving body 20 is not activated, control to completely deactivate the second electric motor M2 is performed. However, the configuration may also be such that in the case where the influence of time delay in the activation of revolution relative to the lever operation is large, control to rotate the second electric motor M2 and the hydraulic pump for revolution P2 at a low speed is performed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This invention claims the benefit of Japanese Patent Application No. 2018-92537 which is hereby incorporated by reference.

What is claimed is:

1. A hydraulic drive unit of a hydraulic excavator, for use in a hydraulic excavator comprising:

a traveling body capable of traveling;

a revolving body provided on the traveling body in a horizontally revolvable manner and horizontally revolved by a revolution hydraulic actuator; and an excavator device provided to the revolving body and driven by a plurality of activation hydraulic actuators, the hydraulic drive unit including:

a first hydraulic pump that discharges a hydraulic oil for activating the plurality of activation hydraulic actuators;

a first electric motor that drives the first hydraulic pump;

a hydraulic pump for revolution that discharges a hydraulic oil for activating the revolution hydraulic actuator;

a second electric motor that drives the hydraulic pump for revolution; and a motor controller that controls the rotation of the first electric motor and that of the second electric motor, an actuator operation unit operated to activate each of the plurality of activation hydraulic actuators and the revolution hydraulic actuator;

a plurality of first control valves that control the flow rates of respective hydraulic oils supplied from the first hydraulic pump to the plurality of activation hydraulic actuators;

a revolution control valve that controls the flow rate of a hydraulic oil supplied from the hydraulic pump for revolution to the revolution hydraulic actuator; and a pilot pressure supply unit that supplies a pilot pressure for driving each of the plurality of first control valves and the revolution control valve according to the operation of the actuator operation unit, wherein the pilot pressure supply unit generates the pilot pressure using a hydraulic oil discharged from the first hydraulic pump, and the hydraulic drive unit being characterized in that when the revolution of the revolving body is not activated by the revolution hydraulic actuator, the motor controller performs control to deactivate the second electric motor.

2. The hydraulic drive unit of a hydraulic excavator according to claim 1, wherein the motor controller controls the rotation of the second electric motor, thereby controlling the revolution speed at the time of activating the revolution of the revolving body by the revolution hydraulic actuator.

3. The hydraulic drive unit of a hydraulic excavator according to claim 1, comprising a pressure sensor that detects the maximum load pressure among the load pressures of the plurality of activation hydraulic actuators, and wherein the motor controller controls the rotation of the first electric motor, thereby controlling the discharge flow rate of the first hydraulic pump in such a manner that the discharge pressure of the first hydraulic pump is higher than the maximum load pressure.

4. The hydraulic drive unit of a hydraulic excavator according to claim 1, wherein when at least one of the plurality of activation hydraulic actuators and the revolution hydraulic actuator are activated together, the motor controller controls the rotation of the first electric motor, thereby controlling the discharge flow rate of the first hydraulic pump in such a manner that the discharge flow rate of the first hydraulic pump is reduced by the discharge flow rate of the hydraulic pump for revolution.

5. The hydraulic drive unit of a hydraulic excavator according to claim 1, wherein the first hydraulic pump discharges a hydraulic oil for activating a traveling hydraulic motor provided to the traveling body.

* * * * *